US007128487B2

(12) United States Patent
Maruyama et al.

(10) Patent No.: US 7,128,487 B2
(45) Date of Patent: Oct. 31, 2006

(54) MECHANICAL PENCIL

(75) Inventors: Shigeki Maruyama, Tokyo (JP); Masaki Shigemori, Tokyo (JP); Hidetoshi Kodama, Tokyo (JP)

(73) Assignee: Pentel Kabushiki Kaisha (JP)

( * ) Notice: Subject to any disclaimer, the term of this patent is extended or adjusted under 35 U.S.C. 154(b) by 0 days.

(21) Appl. No.: 10/489,570

(22) PCT Filed: Sep. 24, 2002

(86) PCT No.: PCT/JP02/09758

§ 371 (c)(1),
(2), (4) Date: Mar. 11, 2004

(87) PCT Pub. No.: WO03/029021

PCT Pub. Date: Apr. 10, 2003

(65) Prior Publication Data

US 2004/0247371 A1 Dec. 9, 2004

(30) Foreign Application Priority Data

Sep. 28, 2001 (JP) ..... 2001-299757
Nov. 29, 2001 (JP) ..... 2001-364946

(51) Int. Cl.
*B43K 21/22* (2006.01)

(52) U.S. Cl. ..... 401/92

(58) Field of Classification Search ..... 401/86, 401/87, 92–94
See application file for complete search history.

(56) References Cited

U.S. PATENT DOCUMENTS 2,174,979 A * 10/1939 Hauton ..... 401/64
4,281,939 A * 8/1981 Mitsuya ..... 401/54
5,085,534 A * 2/1992 Kenichi et al. ..... 401/65

FOREIGN PATENT DOCUMENTS

| | | |
|---|---|---|
| EP | 1151874 | 11/2001 |
| JP | 58032959 | 7/1983 |
| JP | 62087884 | 6/1987 |
| JP | 2099689 | 8/1990 |
| JP | 09183294 | 7/1997 |
| JP | 00015986 | 1/2000 |

* cited by examiner

*Primary Examiner*—Huyen Le
(74) *Attorney, Agent, or Firm*—Adams & Wilks

(57) ABSTRACT

In a mechanical pencil, the dispersion range of the diameter of a lead is allowable to a certain extent, but if by chance a lead having the maximum diameter is used the lead may not be delivered. This is because there is exceeded the allowable range of the elastic deformation of an elastic thin film, namely, a lead holding member. The mechanical pencil includes the lead holding member disposed in the neighborhood of the tip of a shaft tube, in which the exterior shape of the lead holding member is formed to be slightly smaller than the interior shape of the shaft tube in which the lead holding member is disposed, and an inner step portion for preventing the dropping of the lead holding member from the shaft tube is disposed in the front portion of the lead holding member.

15 Claims, 7 Drawing Sheets

MECHANICAL PENCIL

CROSS REFERENCE TO RELATED APPLICATIONS

This application is a U.S. national stage application of copending International Application No. PCT/JP02/09758, filed Sep. 24, 2002, claiming priority dates of Sep. 28, 2001 and Nov. 29, 2001, and published in a non-English language.

TECHNICAL FILED OF THE INVENTION

The present invention relates to a mechanical pencil comprising a lead holding part disposed in the neighborhood of the tip of a shaft tube.

BACKGROUND OF THE INVENTION

Description will be made on Japanese Utility Model Publication No. 58-32959 as an example of an above described type of mechanical pencil. In this publication gazette, claim 1 is found to describe that "a lead protection device comprising a lead passage tube and a lead holding part both disposed, freely slidably or nonslidably, in the tip of the main body of a mechanical pencil for thin leads, characterized in that the lead protection part is formed by laminating an elastic thin film made of rubber and the like, as integrally molded one piece, on the interior surface of the lead passage tube." In other words, the integral formation of the elastic thin film on the interior surface of the lead passage tube makes it possible to effectively use even shortened leads.

In this connection, JIS, the Japanese Industrial Standard, specifies the maximum and minimum diameters of the lead, namely, the dispersion range of the lead diameter; for example, a lead of a nominal diameter of 0.5 (mm) is specified to fall within a diameter range from 0.58 mm (maximum diameter) to 0.55 mm (minimum diameter). Accordingly, the inside diameter of the above described lead holding member is designed in conformity with the specified smallest diameter of the leads used to allow a lead having the minimum diameter specified to be held. More specifically, when a lead is delivered, the lead is delivered while the lead is always pressed to expand the lead holding member and is thereby made to advance.

In the above described prior art, the lead holding part sticks fast to the lead passage tube to form one integrally molded piece; accordingly although a certain dispersion range of the lead diameter is allowable, sometimes the leads are not delivered when the maximum diameter leads are used, indicating that the allowable range of the elastic deformation of the elastic thin film, namely, the lead holding member is exceeded.

SUMMARY OF THE INVENTION

An object of the present invention is to overcome the above described drawbacks of the prior art and to provide an improved mechanical pencil.

Another object of the present invention is the provision of an improved mechanical pencil which ensures a reliable holding of a lead and can also provide a satisfactory delivery operation of the lead.

In a first embodiment of the present invention, there is provided a mechanical pencil comprising a lead holding member disposed in the neighborhood of the tip of a shaft tube of the pencil, wherein the exterior shape of the above described lead holding member is made slightly smaller than the interior shape of the above described shaft tube in which the lead holding member is disposed, and simultaneously an inner step portion is disposed in the front portion of the lead holding member for the purpose of preventing the dropping of the lead holding member from the shaft tube.

In a second embodiment of the present invention, there is provided a mechanical pencil comprising a lead holding member disposed in the neighborhood of the tip of a shaft tube of the pencil, wherein the sectional shape of an interior surface of the above described lead holding part is made to have a variant shape, the lead holding member is made to be movable back and forth, and simultaneously an inner step portion is disposed in the front portion of the lead holding member for the purpose of preventing the dropping of the lead holding member from the shaft tube.

The above described configurations allow the dispersion of the lead diameter to be absorbed by the elastic radial and longitudinal deformations of the lead holding member, by the clearance between the lead holding member and the shaft tube, and moreover by the empty space formed between the lead and the lead holding member.

DETAILED DESCRIPTION OF THE INVENTION

Figure 1:
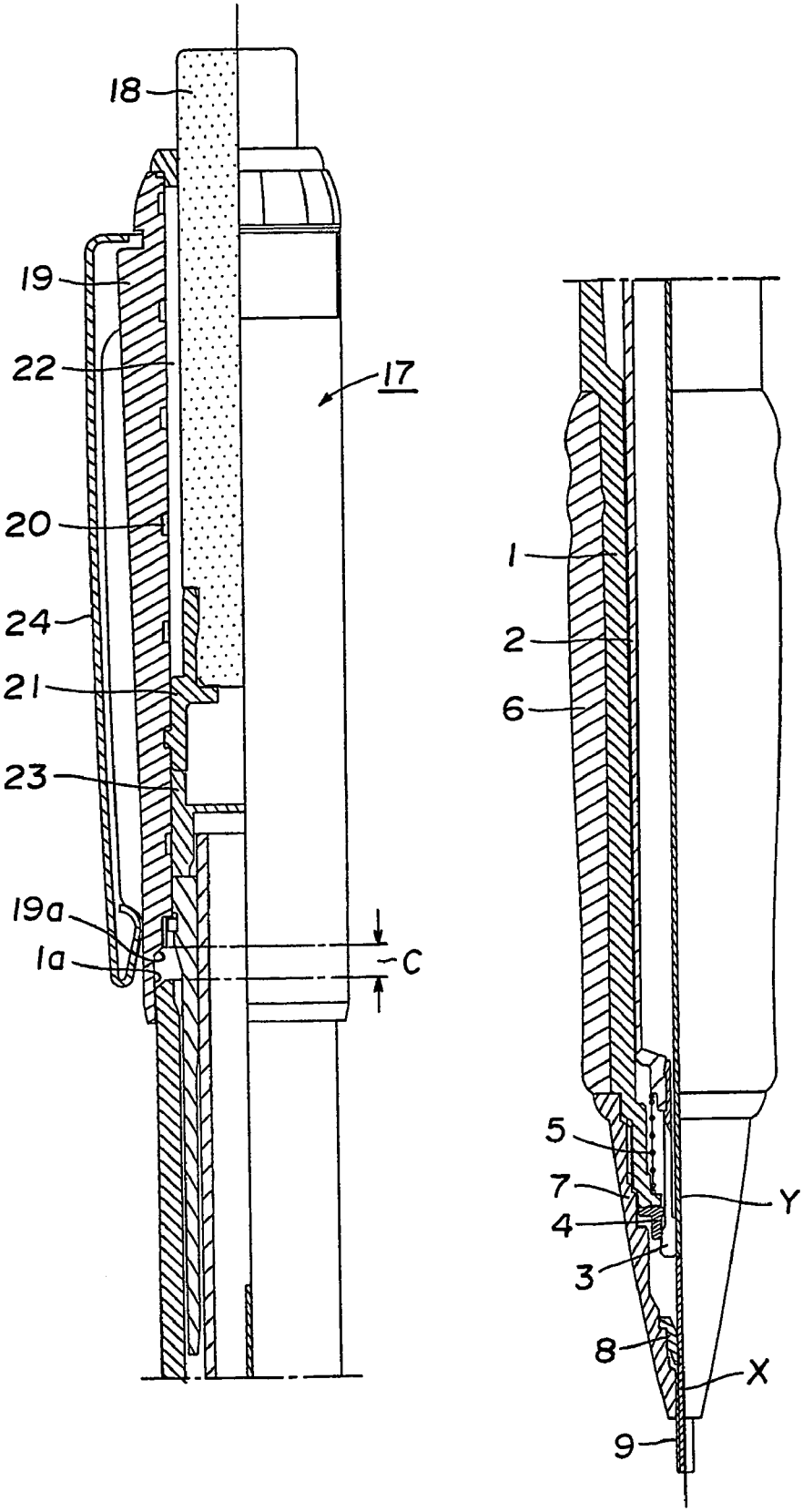
FIG. 1 is a longitudinal half sectional view of a mechanical pencil according to one embodiment of the present invention.

Description will be made below on a preferred embodiment of the present invention with reference to FIGS. 1 to 4. In the interior of a front shaft 1, a lead tank 2 housing a plurality of leads is disposed freely slidably, and a chuck body 3 conducting the grasping and releasing of a lead is fixed to the front end of the lead tank 2. A chuck ring 4 conducting the open/close operation of the chuck body 3 surrounds the front portion of the chuck body 3. Reference numeral 5 denotes an elastic member such as a coil spring for backward biasing the above described lead tank 2 and the chuck body 3. Reference numeral 6 denotes a grip member installed freely attachably and detachably in the exterior circumference of the front portion of the front shaft 1 and made of a rubber-like elastic material; however, the surface of the front shaft 1 may be subjected to knurling and the like, and is made to display an antiskid effect when being held owing to the knurl.

Additionally, a front member 7 is installed freely attachably and detachably at the front end of the above described front shaft 1 such as by screwing the parts together; however, the front member 7 may be integrally molded in the front shaft 1. A guide member 8 for forwardly guiding the lead, made of a rubber-like elastic material, is disposed in the interior of the front member 7, but the guide member 8 is not necessarily an indispensable member and can be omitted if desired. For the purpose of improving the visibility in writing, a lead protection tube or tubular member 9 made of a metallic material such as stainless steel is pressed into and fixed in the front end of the front member 7, but the lead protection tube 9 may be disposed by integrally molding together with the front member 7 or by the like processing.

Inside the lead protection tube 9, a tubular lead holding member 10 according to the invention is disposed. The lead holding member 10 is prevented from dropping from the lead protection tube 9 with the aid of securement rings 11, 12 respectively pressed into the neighborhoods of both ends of the lead protection tube 9. The securement rings 11, 12 define inner step portions, and the lead holding member 10 has a length such that the member 10 can move back and forth along an axial (longitudinal) direction of the lead protection tube 9 between the inner step portions 11, 12. In other words, the lead holding member 10 can move back and forth between the above described securement rings 11, 12. Needless to say, the inside diameters S1 of the securement rings 11, 12 are made to be larger than the outside diameter T of the lead, and the inside diameter S1 of the securement ring 12 disposed in the front portion of the lead protection tube 9 is made to be merely slightly larger than the outside diameter T of the lead. In other words, the securement ring 12 prevents the positional fluctuation of the lead at the time of writing as completely as possible. Incidentally, the securement ring 11 disposed in the rear portion may be omitted, and accordingly the above described guide member 8 may be made and used to prevent the drop of the lead holding member 10.

Figure 3:
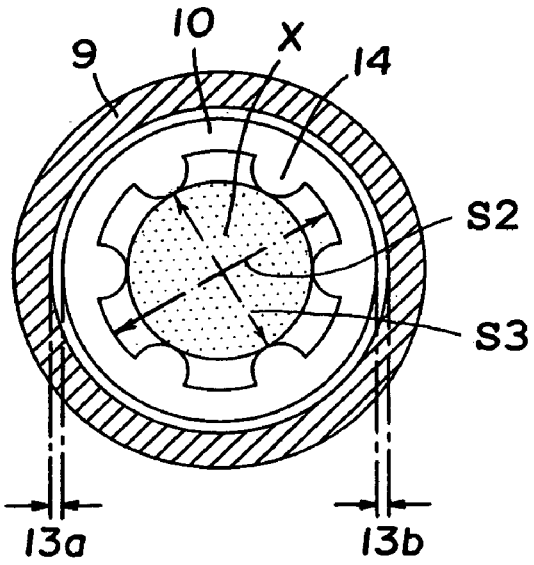
FIG. 3 is an enlarged transverse sectional view of an important portion of FIG. 2.
Figure 4:
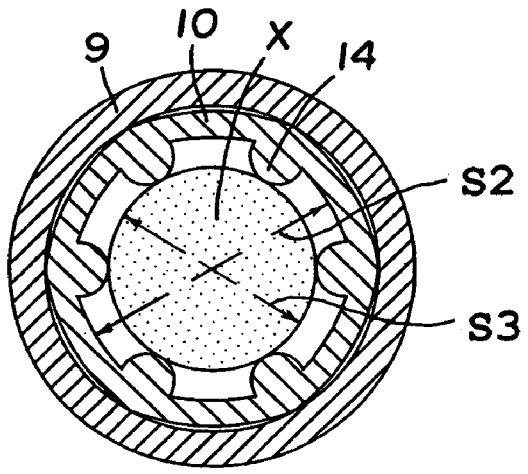
FIG. 4 is a sectional view illustrating an example of operation.
Figure 5:
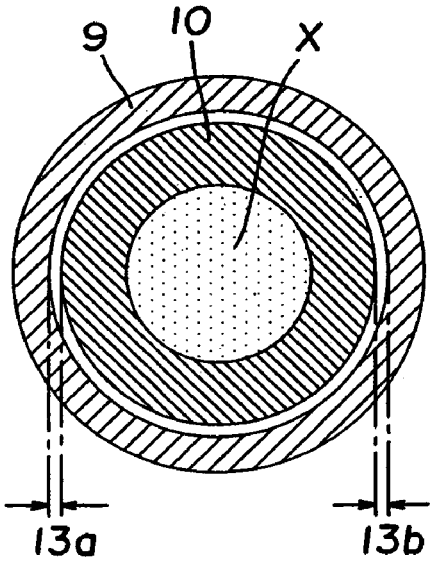
FIG. 5 is a transverse sectional view illustrating a modification of FIG. 3.

The outside diameter of the lead holding member 10 is made to be slightly smaller than the inside diameter of the lead protection tube 9, and this configuration forms a clearance 13. The clearance 13 is formed on both sides as shown in FIGS. 3 and 5 (a clearance 13*a*, a clearance 13*b*); however, depending on the location of the lead holding member 10, sometimes the clearance 13 is one-sided and formed merely on any one side of the both sides. The total sum of the clearance 13 formed on both sides (the clearance 13*a*, the clearance 13*b*) amounts to 6.7% or more of the diameter of lead being used. Specifically, the total sum amounts to 6.7% or more of the nominal diameter of the lead according to the JIS standard; for example, for a nominal lead diameter of 0.3 (mm), the clearance 13 amounts to 0.0201 mm (=0.3×0.067) or more. As described above, the clearance 13 is the sum of the clearance 13*a* and the clearance 13*b* formed on both sides. Furthermore, a specific description based on the present embodiment depicts that when the present embodiment having the clearance 13 of 0.0201 mm uses a lead having a nominal diameter of 0.3 mm, the maximum diameter (the diameter is 0.39 mm) within the dispersion of the lead diameter results in a light contact of the exterior surface of the lead holding member 10 with the interior surface of the lead protection tube 9; substantially, the exterior surface portions of the lead holding member 10 where ribs 14 are located contact the interior surface of the lead protection tube 9 (see FIG. 4).

In this connection, for example, if the clearance 13 is made to be 20% of the nominal lead diameter, the lead is held by the lead holding member 10, but the clearance 13 is still formed between the lead holding member 10 and the lead protection tube 9, so that the lead conceivably fluctuates in position at the time of writing in such a way that writing cannot be conducted smoothly; however, the above described securement rings 11, 12 serve to prevent the positional fluctuation of the lead, so that writing can be conducted without feeling the sense of discomfort. On the other hand, with the clearance 13 of 6.7% or less of the nominal lead diameter, as described in the prior art disclosure section, when a lead having a large diameter (the maximum diameter of the lead diameter dispersion: for example, the maximum diameter for the nominal lead diameter of 0.3 mm is 0.39 mm) is used, there is a risk that the lead is not delivered; the exterior surface of the lead holding member 10 is pressed to contact the interior surface of the lead protection tube 9, resulting in a condition such that the elastic expansion of the lead holding member 10 by pressing is impossible.

Figure 2:
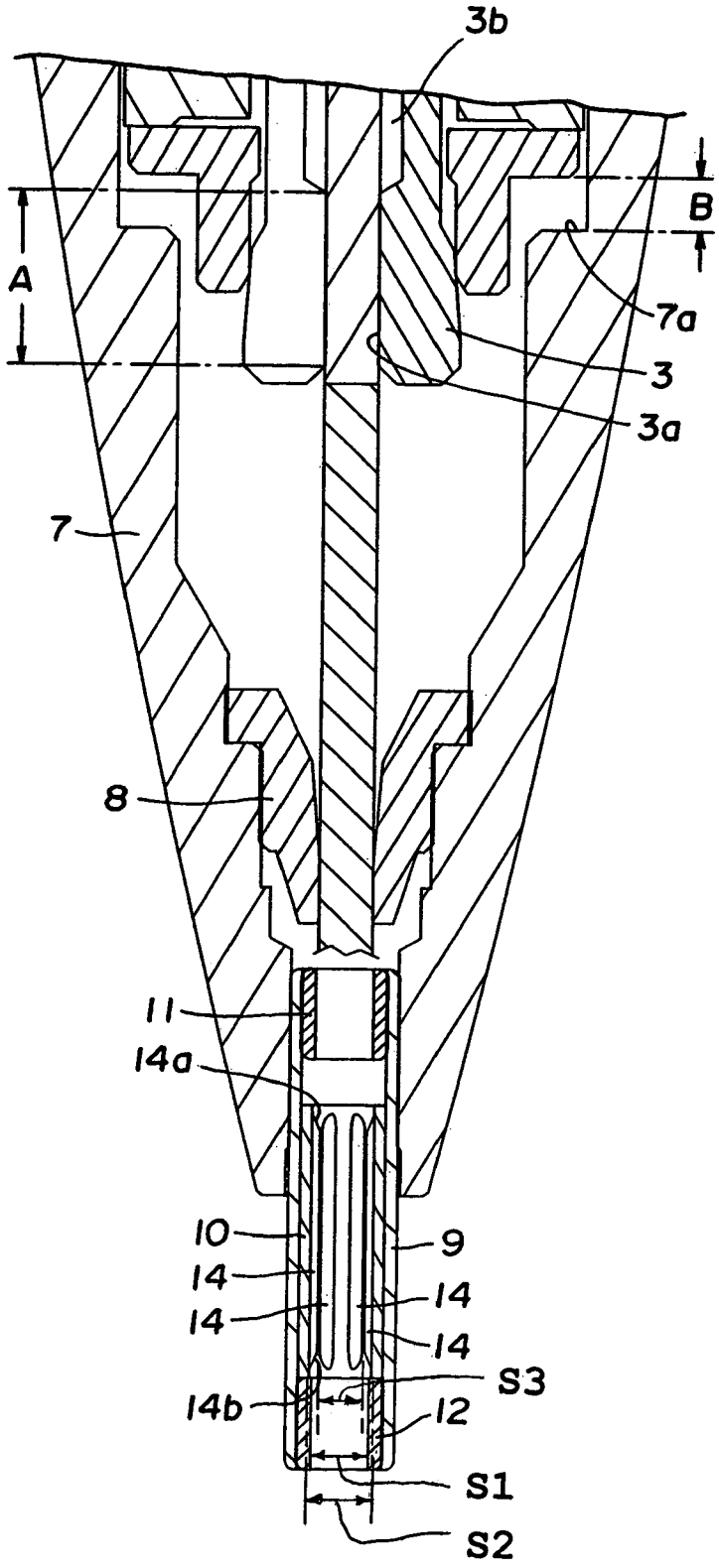
FIG. 2 is an enlarged view of an important portion of FIG. 1.

On the inner or interior surface of the lead holding member 10 of the present embodiment, six (6) lengthwise extending longitudinal ribs 14 are formed at circumferentially spaced-apart even intervals, but it is not necessary to be constrained by this number of ribs and any desired number of ribs may be provided, such as 4, 8, or 10 longitudinal ribs may be formed at even intervals. As shown, for example, in FIG. 3, the lead holding member 10 has a first inner diameter S2 at diametrical portions thereof where there are no longitudinal ribs 14, and a second inner diameter S3 smaller than the first inner diameter S2 at diametrical portions thereof where there are longitudinal ribs 14. In other words, the diameter S3 of the circle inscribed within the longitudinal ribs 14 is smaller than the diameter S2 of the circle inscribed where the longitudinal ribs 14 are not present. The diameter S3 of the incircle for the longitudinal ribs 14 is equal to or slightly smaller than the minimum value associated with the nominal diameter T of the lead based on JIS (Japanese Industrial Standards; hereinafter the same abbreviation will be used). In other words, the lead X is held to a light degree by the above described longitudinal ribs 14. Specifically, when a lead of the minimum diameter T is used, the outside diameter of the lead becomes in line contact with the apexes of the longitudinal ribs 14, while when a lead of the maximum diameter T is used, the lead holding member 10 itself is elastically pressed to expand, and additionally the longitudinal ribs 14 are elastically deformed so that the lead becomes in surface contact with the ribs 14. As illustrated in FIG. 2, the inner diameter S1 of the inner step portion 12 is smaller than the first inner diameter S2 and larger than the second inner diameter S3 of the lead holding member 10. In this way, in the present embodiment of the invention, the formation of the longitudinal ribs 14 makes it possible even for the lead positioned at the dispersion upper limit of the JIS standard to be delivered without fail, and also makes it possible for those leads slightly deviating from the JIS standard to be held and delivered without fail.

Furthermore, the front and rear ends of each of the longitudinal ribs 14 of the lead holding member 10 are subjected to chamfering machining (chamfered portions 14*a*, 14*b*). The rear end chamfered portions 14*a* serve to make the lead passage behavior satisfactory when the lead is delivered, while the front end chamfered portions 14*b* serve to make the lead retracting/housing operation satisfactory.

As shown in FIG. 5, the sectional shape of the lead holding member 10 may be made to be circular. Also in this case, the clearance 13 is formed between the lead holding member 10 and the lead protection tube 9 similarly to the previous embodiment of the invention, and the clearance 13 is 6.7% or more of the diameter of the lead used. The present modification sometimes fails to exhibit the effect of the present invention for leads falling outside the JIS standard, depending on the elastic deformation rate of the lead holding member 10; however, the present modification can sufficiently exhibit the effect for the dispersion falling within the range specified by the JIS standard.

Figure 6:
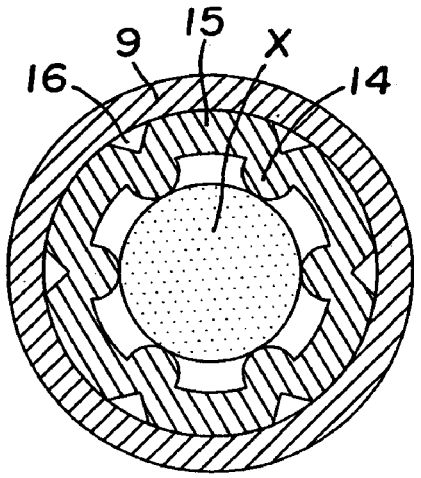
FIG. 6 is a transverse sectional view illustrating an additional modification of FIG. 3.

Another modification of the lead holding member will be described with reference to FIG. 6. This is a modification in which the longitudinal ribs 14 are formed on the interior surface of a lead holding member 15 similarly to the above described embodiment, and longitudinal grooves 16 are concurrently formed on the exterior surface of the lead holding member 15. Specifically, these longitudinal grooves 16 are formed at the outside locations opposite to the longitudinal ribs 14 formed on the interior surface. In other words, in the present modification, the longitudinal ribs 14 are elastically deformable, and additionally the longitudinal ribs 14 can be pressed to expand radially outwardly by taking advantage of the longitudinal grooves 16.

Incidentally, in the present modification, when the lead holding member 15 is inserted into the lead protection tube 9, the lead holding member 15 can be shrunk radially by user's fingers and the like, and accordingly the present modification has a structure capable of improving the assemblability. Even without conducting the radial shrinkage, the contact area between the lead holding member 15 and the interior surface of the lead protection tube is small, so that the insertion of the member can be conducted easily.

Examples of the materials for the lead holding tube 9 and the lead holding members 10, 15 will be listed, but the materials are not limited to the listed examples, and can be selected from other various materials. The materials for the lead protection tube 9 are not particularly limited as far as the materials permit the formation of pipe like shapes; and examples of such materials include metallic materials such as aluminum or alloys thereof, cupper or alloys thereof, iron or alloys thereof, zinc or alloys thereof, and magnesium and alloys thereof; thermoplastic resins such as ABS, AS, acryl, polycarbonate, polypropylene, polyethylene, polyester, and polystyrene; and natural materials including ceramic materials such as alumina, zirconia and china clay.

Specific examples of the elastic resins used for the lead holding members 10, 15 include epoxy resin, urethane resin, acryl melamine resin, acryl silicon resin, acryl urethane resin, unsaturated polyester resin, alkyd resin, silicon resin, vinyl chloride, vinyl acetate, vinyl chloride-acetate copolymer, vinyl butyral polymer, silicone rubber, urethane rubber, ethylene-acrylic rubber, epichlorhydrin rubber, acrylic rubber, ethylene-propylene rubber, chloroprene rubber, natural rubber, isoprene rubber, chlorinated polyethylene, nitrile rubber, styrene-based elastomer, olefin-based elastomer, ester-based eleastomer, and urethane-based eleastomer. Furthermore, ultraviolet-curing resins can also be used, and examples of such resins include monofunctional and multifunctional monomers derived from arylic acid ester and methacrylic acid ester each having an acryloyl group at the terminal position; photopolymerizable polymers such as polyester acrylate, epoxy acrylate, polyurethane acrylate, polyether acrylate, melamine acrylate, and alkyd acrylate. The monomers are not used alone, but in combination with the photopolymerizable prepolymers, and the photopolymerizable prepolymers are used each alone or in combinations of two or more types thereof. These resins may be made to contain foaming agents, powders and the like.

As the foaming agents, chemical foaming agents, physical foaming agents, thermally expansible microcapsules and the like are used. Specific examples of the chemical foaming agents include organic thermal decomposition type foaming agents such as azo compounds, nitroso compounds, hydrazine derivatives, semicarbazide compounds, azide compounds, triazole compounds; organic reaction type foaming agents such as isocyanate compounds; inorganic thermal decomposition type foaming agents such as bicarbonates, carbonates, sulfites, and hydrides; and inorganic reaction type foaming agents such as a mixture of sodium bicarbonate and an acid, a mixture of hydrogen peroxide and yeast, and a mixture of zinc dust and an acid. Specific examples of the physical foaming agents include butane, pentane, hexane, dichlorethane, dichlormethane, freon, air, carbon dioxide gas and nitrogen gas. Specific examples of thermally expansible microcapsules include microcapsules which comprise, as the core materials, low boiling point hydrocarbons such as isobutane, pentane, petroleum ether and hexane, and, as the shells, thermoplastic resins such as copolymers derived from vinylidene chloride, acrylonitrile, acrylic acid ester and methacrylic acid ester.

Specific examples of the powder include resin powders derived from styrene, nylon, polyolefin, silicon, epoxy and methyl methacrylate resins; and inorganic powders derived from silica, alumina, zirconia and the like. Additionally, the specific examples of the powder also include composite powders in which the above described powders are coated with acryl-based, urethane-based and epoxy-based powder coating films and the like; and furthermore, the powders in which resin powders are made to adsorb or to be penetrated by inorganic powders smaller in size than the resin powders with the aid of an automated mortar, a ball mill, a jet mill, an atomizer, a hybridizer and the like. The powder shape is not particularly limited; spherical, plate-like, and needle-like powders can be used. These powders may be added each alone or in combinations of two or more types thereof. The above described lead holding member may be formed, from the beginning, from a columnar material, and a powder having a melting point higher than those of the above described resins may be added to the lead holding member and then part of the resin contained in the lead holding member may be removed by means of laser beam; this operation yields irregularities on the lead holding member due to the powder, so that the dispersion of the lead diameter can be absorbed to a more advanced extent.

In the present embodiment of the invention, in the rear portion of the front shaft, a stick-like delivery mechanism 17 is disposed freely attachably and detachably, and a projectable and retractable rubber eraser 18 is disposed in the form of a stick. Briefly, on the interior surface of a rear shaft 19, a spiral groove 20 is formed, and a support member 21 driving the rubber eraser 18 upward and downward engages with the spiral groove 20. A stick-like guide member 23 on which a slit 22 is formed intervenes between the above described spiral groove 20 and the support member 21, and the stick-like guide member 23 is press-fitted into a rear portion of the above described lead tank 2 freely attachably and detachably. Polygon shaped portions are formed both on the exterior surface of the front portion of the stick-like guide member 23 and on the interior surface of the rear portion of the above described front shaft 1, which portions engage with each other in a nonrotatable manner. Specifically, by rotating the rear shaft 19 in relation to the front shaft 1, the above described rubber eraser 18 is projected from and retracted into the rear end of the rear shaft 19. Reference numeral 24 denotes a clip fixed to the rear shaft 19, and the clip may be integrally molded with the rear shaft 19.

Figure 7:
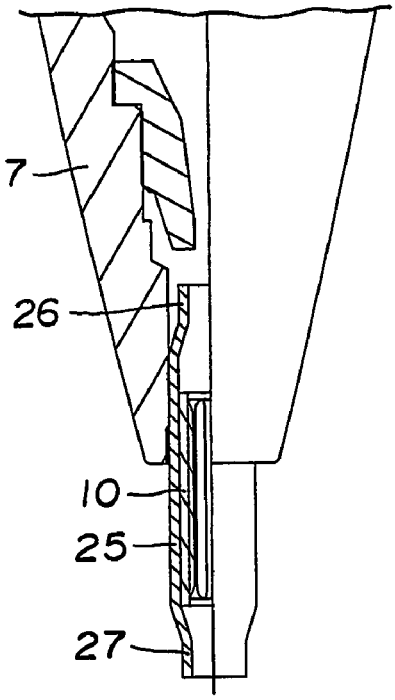
FIG. 7 is a longitudinal sectional view illustrating a modification of a lead protection tube.

Now, description will be made below on various types of modifications of the device for preventing the drop of the above described lead holding member 10(15) from the lead protection tube 9. First of all, a first modification is illustrated in FIG. 7 and described with reference thereto. This is a variation in which the two ends of the lead protection tube 25 are reduced in diameter by means of swaging to form inner step portions, and the lead holding member 10 is prevented from dropping by the diameter-reduced step portions 26, 27. Needless to say, the diameter-reduced step portions 26, 27 are formed in such positions that permit the back and forth movement of the lead holding member 10. In a contrast to the above described embodiment, no securement ring is used, and hence the number of parts can be reduced and the reduction of the costs for parts and the productivity improvement can thereby be implemented. Additionally, in the present modification, the diameter-reduced front end of the lead protection tube 25 permits improving the visibility in writing.

Figure 8:
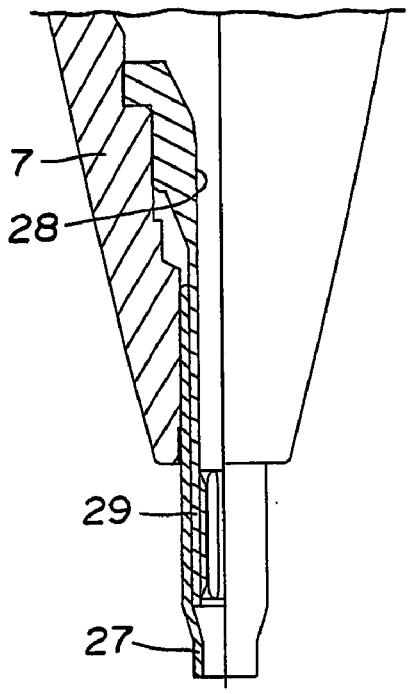
FIG. 8 is a longitudinal sectional view illustrating modification of the lead protection tube and a lead holding member.

A second modification will be described with reference to FIG. 8. In this modification, a guide member 28 and a lead holding member 29 in the first modification are integrally molded in one piece; accordingly, the reduction of the costs for parts and the productivity improvement can be implemented, and because the guide member 28 and the lead holding member 29 are connected with each other, the lead can be smoothly guided from the guide member 28 to the lead holding member 29.

Figure 9:
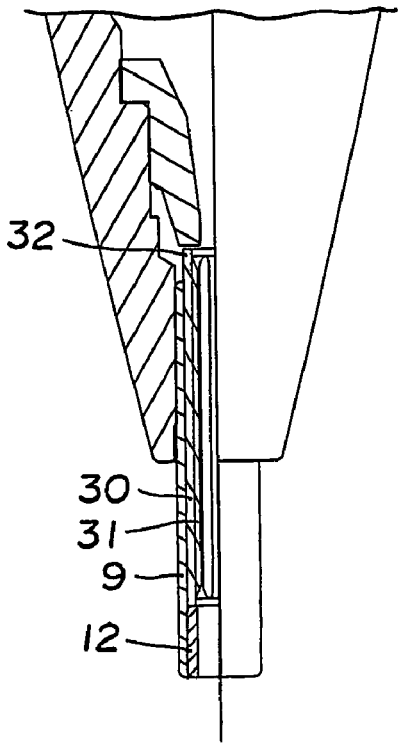
FIG. 9 is a longitudinal sectional view illustrating a modification of the lead holding member.

A third modification will be described with reference to FIG. 9. This is a modification in which a lead holding member 30 and the lead protection tube 9 are integrally molded in one piece by means of the insert molding or two-color molding of the lead holding member 30 in the lead protection tube 9. Thus, the insertion operation can be omitted, so that the productivity improvement can be implemented to a large extent as compared to the above described various examples.

Incidentally, in the present variation, the positional fluctuation of the lead in writing is prevented by an intervening securement ring 12, but a diameter-reduced part may be formed by means of swaging similarly to the above described first modification. In the present modification, needless to say, longitudinal ribs 31 are formed on the interior surface of the lead holding member 30; additionally, the rear end of the lead holding member 30 is made to project from the rear end of the lead protection tube 9. The projecting part 32 also serves to absorb the dispersion of the lead diameter.

Now, description will be made below on the above described chuck body 3 and the chuck ring 4, and the operational displacement distance when delivering the lead, namely, the displacement range of the chuck body 3 and the displacement range of the chuck ring 4 and the like. A lead grasping part 3*a* for actually grasping the lead is formed on the interior surface of the front portion of the chuck body 3. By reference character A is denoted the distance of the lead grasping part 3*a* along the lengthwise direction (the shaft direction). A lead-passage through hole 3*b*, larger in inside diameter than the lead grasping part 3*a*, is formed in the rear portion of the lead grasping part 3*a*. Needless to say, the inside shape of the lead-passage through hole 3*b* is larger than the diameter of the used lead, but not so large as to permit two leads to pass at a time. By reference character B is denoted the distance over which the above described chuck ring 4 can move, namely, the distance over which the chuck ring 4 can move until it abuts to the inner step portion 7*a* formed in the front member 7. By reference character C is denoted the maximum operational displacement distance in the lead delivery, namely, in the present embodiment, the distance over which a below described inner step portion 19*a* of the rear shaft 19 can move until it abuts to the rear end 1*a* of the above described front shaft 1. The interrelation between these distances is such that A+B>C. In other words, the sum distance of the distance (A) of the lead holding part and the chuck ring displacement distance (B) is set to be larger than the operational displacement distance (C) for the lead delivery. Incidentally, examples of devices for regulating the above described operational displacement distance include a device in which an elastic member gets in intimate contact, a device in which the tip of a chuck body abuts to the inner step portion of a front member, and a device in which an operation member burrows into the rear end of a shaft tube.

Figure 10:
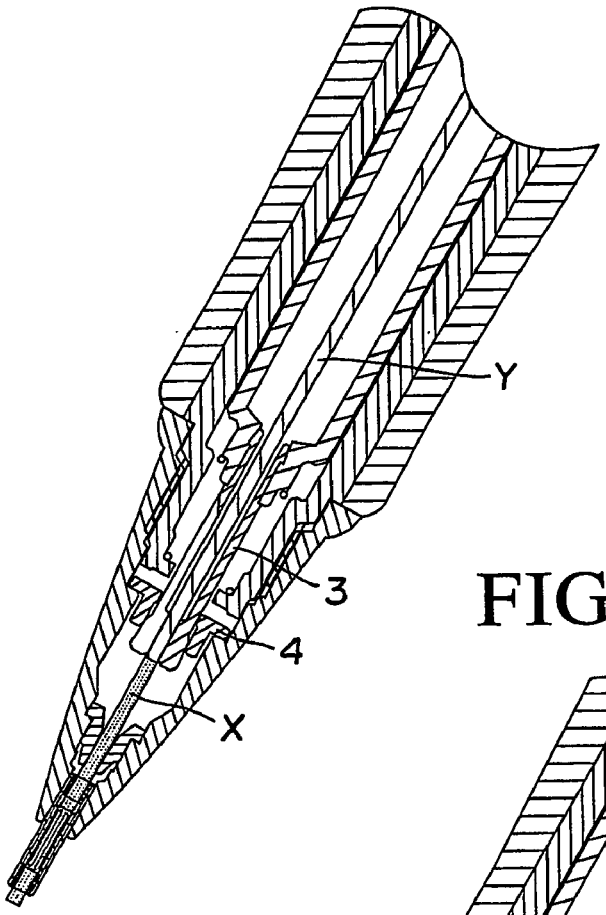
FIG. 10 is a longitudinal sectional view of an important portion illustrating an example of the operation of the lead delivery.
Figure 11:
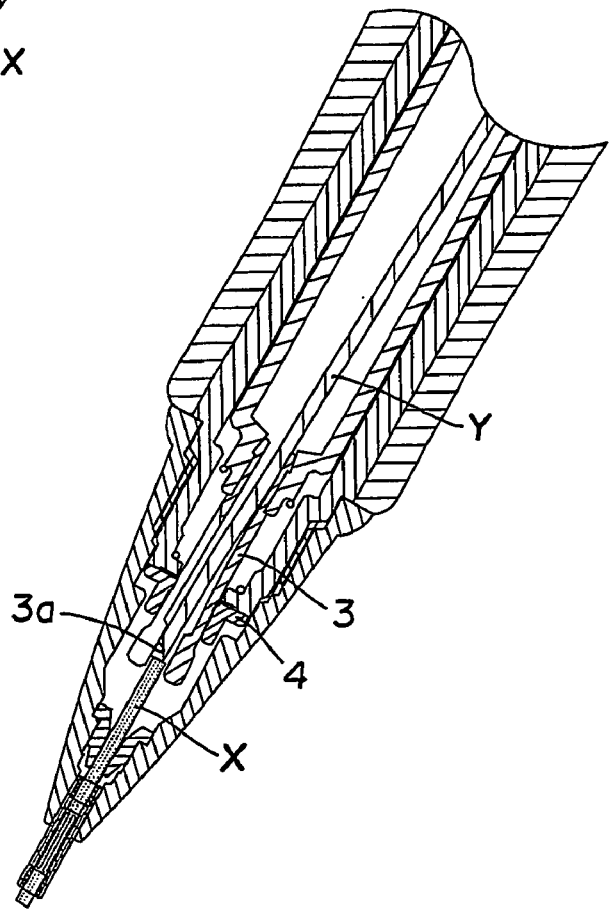
FIG. 11 is a longitudinal sectional view of an important portion illustrating another example of the operation of the lead delivery.
Figure 12:
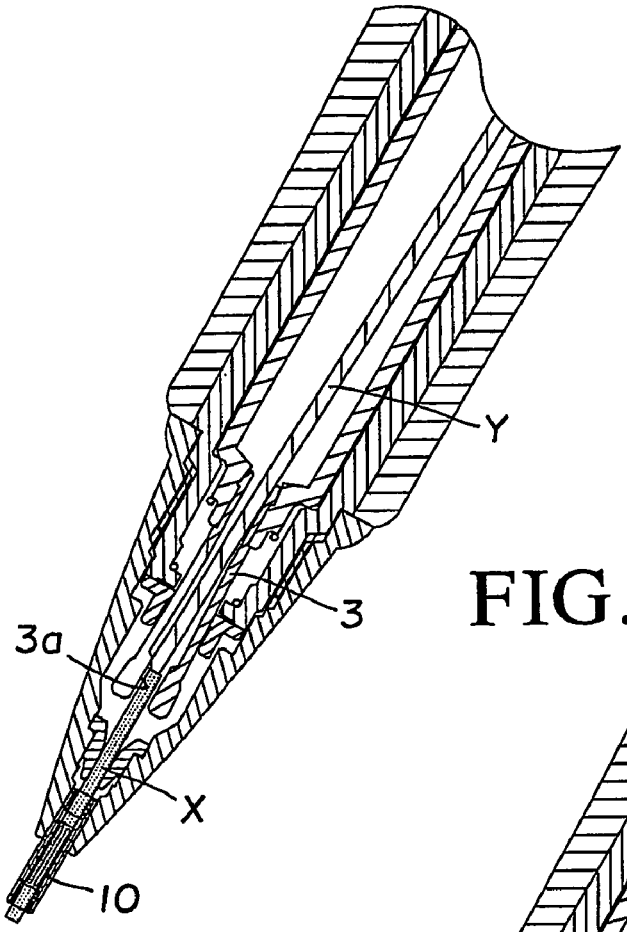
FIG. 12 is a longitudinal sectional view of an important portion illustrating another example of the operation of the lead delivery.

Now, description will be made below on the operation. The lead deliver operation starting from the condition shown in FIG. 1 (FIG. 2) is such that when the rear shaft 19 is pressed and accordingly the lead tank 2 is made to advance, the chuck body 3 having grasped the follow-on (that is, succeeding) lead Y advances together with the chuck ring 4. Concurrently with the advancement of the follow-on lead Y, the remnant lead X is also pressed to advance. In the course of time, the chuck ring 4 abuts to the inner step portion 7*a* of the front member 7 and the advancement movement of the chuck ring 4 is blocked (see FIG. 10); at this time, the follow-on lead Y grasped by the chuck body 3 is released, and then slightly inclined in relation to the shaft axis of the lead tank 2; however, the front end of the follow-on lead Y is not in contact with the inside diameter of the lead-passage through hole 3*b* but in contact with the inside diameter of the lead grasping part 3*a* smaller than the inside diameter of the lead-passage through hole 3*b*, so that the inclination angle of the follow-on lead Y is extremely small (see FIG. 11). Then, the chuck body 3 is made to further advance, but the advancement of the follow-on lead Y is blocked because the follow-on lead Y has been released from the chuck body 3, and additionally the remnant lead X is held by the lead holding member 10. At this time, the front end of the follow-on lead Y is located near the rear portion of the lead grasping part 3*a* of the chuck body 3. In other words, the lead grasping part 3*a* is made to be sufficiently long, so that the front end of the follow-on lead Y can fall within the range of the lead grasping part 3*a* (see FIG. 12).

Figure 13:
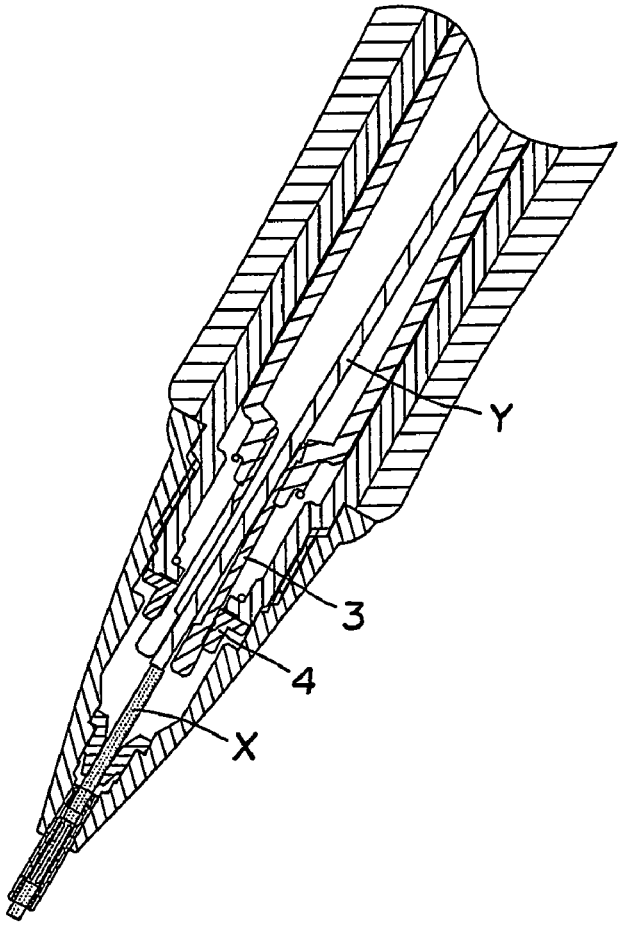
FIG. 13 is a longitudinal sectional view of an important portion illustrating another example of the operation of the lead delivery.

At this step, the lead delivery operation is released, and then the above described lead tank 2 is retracted by the biasing force of the elastic member 5, the chuck body 3 is also retracted, and the released chuck body 3 comes to contact the chuck ring 4. At this time, a clearance is instantly formed between the follow-on lead Y and the remnant lead X, and the chuck body 3 being retracted comes to close; however, because the follow-on lead Y is located near the rear portion of the lead grasping part 3*a*, the inclination angle of the above described follow-on lead Y becomes gradually small in coupling with the closing movement of the above described chuck body 3, and eventually the follow-on lead Y is made to drop by gravity along the surface of the lead grasping part 3*a* to once again contact the remnant lead X (see FIG. 13).

Figure 14:
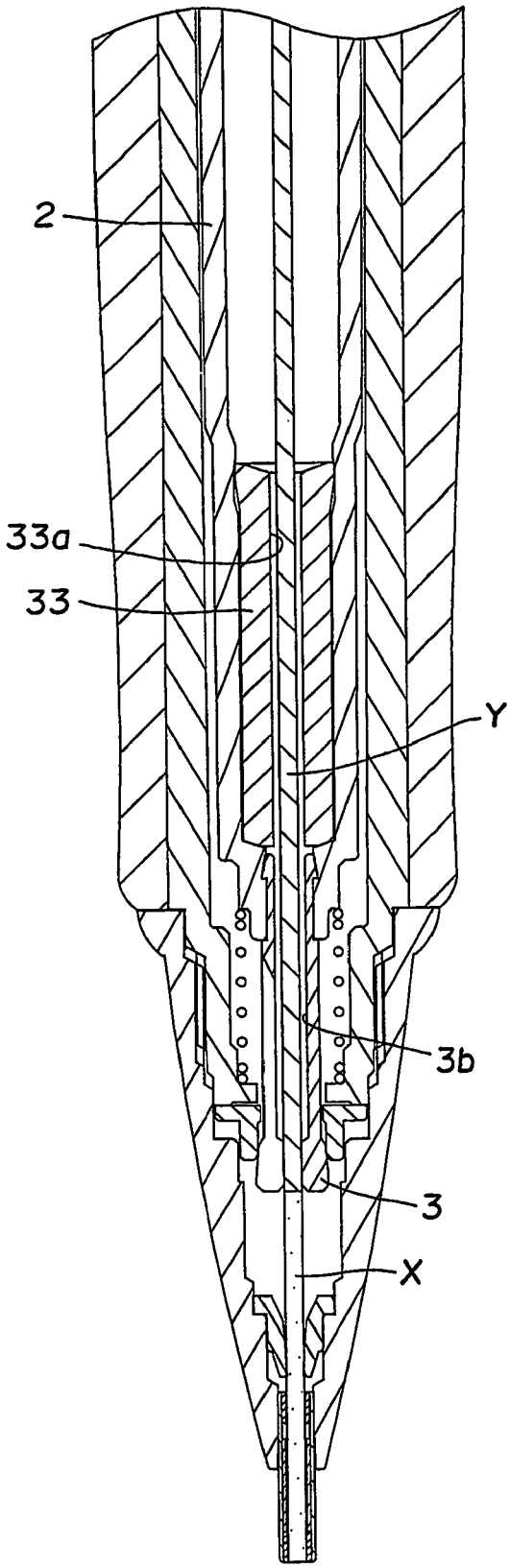
FIG. 14 is a longitudinal sectional view of an important portion of a modification of the embodiment of the present invention.

A modification of the present embodiment will be described with reference to FIG. 14. This is a modification in which a guide member 33, having a through hole 33*a* formed therein somewhat larger in diameter than the lead, is inserted into the above described lead tank 2. Needless to say, the diameter of the through hole 33*a* is not so large as to permit two leads to pass at a time. The through hole 33*a* is formed as an extension of the lead-passage through hole 3*b* of the chuck body 3, so that the through hole 33*a* has a structure capable of fully preventing the inclination of the follow-on lead Y. Consequently, even when the angle between the writing plane and the mechanical pencil is made small while conducting the lead delivery operation, the lead can be delivered smoothly.

The chuck body 3 in the present embodiment is formed of a metallic material, but may be a molded resin article. However, it is preferable that the material for the chuck body 3 is a metallic material for the purpose of suppressing the retraction distance of the follow-on lead and alleviating the sense of discomfort in writing.

Additionally, in the present embodiment, the distance of the lead grasping part 3*a* is elongated; however, the distance of the grasping part is elongated not by arranging the grasping part as an extension of the rear portion of the grasping part of the usual chuck body, but by arranging as an extension of the front portion thereof. The retraction of the follow-on lead caused by contacting the chuck body, after the chuck body has been in contact with the chuck ring, is made to be as small as possible, and thereby the generation of the clearance between the follow-on lead and the remnant lead is prevented as much as possible. Furthermore, the displacement distance of the chuck ring is also taken to be large in the present embodiment; however, a large displacement distance thereof, if it is too large, results in a large lead delivery distance, leading to the sense of discomfort, so that it is needed that the displacement distance be set appropriately.

Now, description will be made below on the interior surface shape of the above described lead holding member and a satisfactory configuration in which the lead contacts the interior surface shape. The sectional shape of the interior surface of the lead holding member is important in the present invention, and may take an elliptical shape, an polygonal shape, and a slit-like shape, in addition to the above described shape, without being particularly limited as far as it is a variant shape other than a circular shape.

However, for the purpose of absorbing the dispersion of the lead diameter, when a lead having the minimum diameter of the lead for the mechanical pencil specified by JIS S 6005 (0.55 mm for the nominal diameter of 0.5) is made to penetrate through the lead holding member, it is necessary for the lead to contact at least the two or more spots of a part of the interior surface of the elastic resin portion, and it is also necessary that some empty space (portion) is left. The presence of the empty space makes it possible for the contact portion to be deformed, allowing the dispersion in the lead holding force to be absorbed, even when a lead having the maximum diameter (0.58 mm for the nominal diameter of 0.5) is made to penetrate.

Additionally, when the sectional area corresponding to the minimum lead diameter (0.55 mm for the nominal diameter of 0.5) is denoted by X and the sectional area of the empty space (the sectional area of the empty space formed when a lead of the minimum diameter is made to penetrate) is denoted by Y, by making X and Y satisfying the relation that 0.09 s $Y/X \leqq 1.12$, the lead holding member can be compatible with all the leads (nominal diameters of 0.3, 0.5, 0.7, 0.9 and 2.0) and color leads for use in a mechanical pencil specified by JIS S 6005. Additionally, the lead holding member can be compatible with the leads other than the leads and color leads for use in a mechanical pencil specified by JIS S 6005, as far as the lead diameters fall within the range from 0.275 mm to 2.07 mm.

Now, description will be made on an example of the nominal diameter of 0.5. For the nominal diameter of 0.5 specified by JIS S 6005, the minimum value of the diameter is 0.55 mm and the associated sectional area is 0.238 $mm^2$; on the other hand, the maximum value of the diameter is 0.58 mm and the associated sectional area is 0.264 $mm^2$. When a lead having the diameter of 0.55 mm is made to penetrate through the lead holding member, it is necessary for the lead to contact at least the two or more spots of a part of the interior surface of the elastic resin portion, and it is also necessary that some empty space is left. Additionally, the above described empty space is also needed to be left when a lead having the diameter of 0.58 mm is made to penetrate, and hence it is necessary that the sectional area of the empty space is equal to or more than the difference between the sectional area of the 0.58 mm lead and the sectional area of the 0.55 mm lead. In the other words, the sectional area for the minimum empty space amounts to 0.264 ($mm^2$)−0.238 ($mm^2$)=0.026 ($mm^2$). The ratio of the sectional area of the minimum empty space to the sectional area of the minimum lead amounts to 0.026 ($mm^2$)/0.238 ($mm^2$)=0.11.

Additionally, when there is a space which can accommodate two or more leads for use in a mechanical pencil (the follow-on lead, broken leads and the like), sometimes such a problem occurs that no lead appears even when a knocking operation is conducted. Accordingly, the sectional area of the maximum empty space amounts to the sectional area (0.264 $mm^2$) of the maximum lead. In other words, the ratio of the sectional area of the maximum empty space to the sectional area of the minimum lead amounts to 0.264 ($mm^2$)/0.238 ($mm^2$)=1.12.

From the above, by making the relation of Y/X satisfy the expression that $0.11 \leqq Y/X \leqq 1.12$, the empty space can be left even when a lead of the maximum diameter value (0.58 mm) is made to penetrate, and such a problem that two or more leads are delivered at a time and accordingly no lead appears does not occur.

The leads are scraped by the action of the frictional force generated when delivered, and hence lead dust is accumulated inside the lead holding member, the lead dust adheres and deposited on the surface of the elastic thin film, and the elastic thin film is increased in thickness; under such a condition, the pressure for holding the lead is possibly increased, so that desirable is such a variant shape in which the lead dust can hardly be deposited.

The first embodiment of the present invention provides a mechanical pencil comprising a lead holding member disposed in the neighborhood of the tip of the shaft tube, wherein the exterior shape of the above described lead holding member is formed in a somewhat smaller shape than the interior shape of the above described shaft tube, and an inner step portion for preventing the dropping of the lead holding member from the shaft tube is disposed in the front portion of the lead holding member. Additionally, the second embodiment of the present invention provides a mechanical pencil comprising a lead holding member disposed in the neighborhood of the tip of a shaft tube, wherein the sectional shape of the interior surface of the above described lead holding member is made to be a variant shape, the lead holding member is made to be movable back and forth, and an inner step portion for preventing the dropping of the lead holding member from the shaft tube is disposed in the front portion of the lead holding member. According to these configurations, the lead can be held without fail, and a satisfactory operation of the lead delivery can be attained.

The invention claimed is:

1. A mechanical pencil comprising: a tubular member; a tubular lead holding member disposed in the tubular member near a tip of the tubular member, the lead holding member having one or more longitudinal ribs extending lengthwise on the interior surface thereof so that a sectional shape of the interior surface of the lead holding member has a variant shape, the lead holding member having a first inner diameter at diametrical portions thereof where there are no longitudinal ribs and a second inner diameter smaller than the first inner diameter at diametrical portions thereof where there are one or more longitudinal ribs, the exterior shape of the lead holding member being slightly smaller than the interior shape of the tubular member; and an inner step portion disposed at a front portion of the tubular member for preventing dropping of the lead holding member from the tubular member, the inner step portion having an inner diameter smaller than the first inner diameter and larger than the second inner diameter of the lead holding member.

2. A mechanical pencil according to claim 1; wherein the lead holding member has a plurality of longitudinal ribs.

3. A mechanical pencil according to claim 1; wherein the exterior shape of the lead holding member is smaller than the interior shape of the tubular member under the condition that a lead is not inserted through the lead holding member, but is elastically pressed to expand when the lead is inserted therethrough and contacts the interior surface of the tubular member.

4. A mechanical pencil according to claim 3; wherein the lead holding member has a plurality of longitudinal ribs.

5. A mechanical pencil according to claim 1; wherein the difference between the exterior shape of the lead holding member and the interior shape of the tubular member is 6.7% or more of the diameter of the lead used.

6. A mechanical pencil comprising: a tubular member; a tubular lead holding member movably disposed in the tubular member near a tip thereof to undergo movement back and forth, the lead holding member having one or more longitudinal ribs extending lengthwise on the interior surface thereof so that a sectional shape of the interior surface of the lead holding member has a variant shape, the lead holding member having a first inner diameter at diametrical portions thereof where there are no longitudinal ribs and a second inner diameter smaller than the first inner diameter at diametrical portions thereof where there are one or more longitudinal ribs; and an inner step portion disposed at a front portion of the tubular member for preventing dropping of the lead holding member from the tubular member, the inner step portion having an inner diameter smaller than the first inner diameter and larger than the second inner diameter of the lead holding member.

7. A mechanical pencil having a lead protection tube at a writing tip thereof for protecting a lead projecting from the writing tip, a tubular lead holding member disposed within the lead protection tube for holding the lead, and an inner step portion disposed within the lead protection tube at a front portion thereof for preventing the tubular lead holding member from dropping out of the lead protection tube, the tubular lead holding member having an outer surface directly opposed to an inner surface of the lead protection tube and an inner surface for holding the lead, the inner surface having one or more ribs extending lengthwise therealong, the exterior shape of the tubular lead holding member being smaller than the interior shape of the lead protection tube so that a clearance exists between the exterior of the tubular lead holding member and the interior of the lead protection tube when no lead is inserted into the tubular lead holding member, and the tubular lead holding member being sufficiently elastically expandable in a radial direction so that insertion of a lead into the tubular lead holding member expands the tubular lead holding member radially outwardly into direct contact with the interior surface of the lead protection tube, wherein the tubular lead holding member has a first inner diameter at diametrical portions thereof where there are no longitudinal ribs and a second inner diameter smaller than the first inner diameter at diametrical portions thereof where there are one more longitudinal ribs, and wherein the inner step portion has an inner diameter smaller than the first inner diameter and larger than the second inner diameter of the lead holding member.

8. A mechanical pencil according to claim 7; wherein the inner surface of the tubular lead holding member, when viewed in cross section, has a variant shape due to the one or more ribs.

9. A mechanical pencil according to claim 7; wherein the one or more ribs extend lengthwise along a major part of the length of the tubular lead holding member.

10. A mechanical pencil according to claim 7; wherein the difference between the interior shape of the lead protection tube and the exterior shape of the lead holding member is 6.7% or more of the diameter of the lead.

11. A mechanical pencil according to claim 7; wherein the tubular lead holding member is slidable lengthwise in the lead protection tube within a predetermined range.

12. A mechanical pencil according to claim 7; wherein the tubular lead holding member has a plurality of circumferentially spaced-apart ribs.

13. A mechanical pencil according to claim 12; wherein the plurality of circumferentially spaced-apart ribs are circumferentially spaced apart at even intervals.

14. A mechanical pencil according to claim 7; wherein the tubular lead holding member has a groove extending lengthwise therealong on the outer surface thereof opposite each of the ribs to enhance the elastic expandability of the tubular lead holding member.

15. A mechanical pencil according to claim 7; wherein the tubular lead holding member has a groove extending lengthwise therealong on the outer surface thereof opposite each of the ribs.

* * * * *